US011079189B2

(12) United States Patent
Hsu

(10) Patent No.: US 11,079,189 B2
(45) Date of Patent: Aug. 3, 2021

(54) MODULAR HANDGUN GRIP ASSEMBLY

(71) Applicant: BlackHawk Manufacturing Group Inc., Garden Grove, CA (US)

(72) Inventor: Sheehan Hsu, Garden Grove, CA (US)

(73) Assignee: BLACKHAWK MANUFACTURING GROUP INC., Garden Grove, CA (US)

( * ) Notice: Subject to any disclaimer, the term of this patent is extended or adjusted under 35 U.S.C. 154(b) by 0 days.

(21) Appl. No.: 16/704,609

(22) Filed: Dec. 5, 2019

(65) Prior Publication Data

US 2021/0172691 A1 Jun. 10, 2021

(51) Int. Cl.

| | |
|---|---|
| ***F41A 3/66*** | (2006.01) |
| ***F41C 23/10*** | (2006.01) |
| ***F41A 9/71*** | (2006.01) |
| *F41A 19/11* | (2006.01) |
| *F41A 35/02* | (2006.01) |

(52) U.S. Cl.
CPC *F41A 3/66* (2013.01); *F41A 9/71* (2013.01); *F41C 23/10* (2013.01); *F41A 19/11* (2013.01); *F41A 35/02* (2013.01)

(58) Field of Classification Search
CPC .... F41A 3/66; F41A 9/71; F41C 23/10; F41C 23/00; F41C 23/16
USPC ..... 42/71.02
See application file for complete search history.

(56) References Cited

U.S. PATENT DOCUMENTS

| | | | | |
|---|---|---|---|---|
| D186,446 | S | 10/1959 | Moynihan et al. | |
| D199,064 | S | 9/1964 | Barney | |
| 4,520,585 | A * | 6/1985 | Barrett | F41C 23/10 42/7 |
| 4,862,619 | A | 9/1989 | Baldus et al. | |
| 4,936,036 | A | 6/1990 | Sniezak et al. | |
| 5,231,237 | A * | 7/1993 | Cupp | F41C 23/10 42/71.02 |
| D344,124 | S | 2/1994 | Cupp | |
| D349,938 | S | 8/1994 | Hogue et al. | |
| D351,448 | S | 10/1994 | Fisher | |
| D351,638 | S | 10/1994 | Scott et al. | |
| 5,557,872 | A | 9/1996 | Langner | |
| D376,187 | S | 12/1996 | Haber et al. | |
| 5,621,995 | A | 4/1997 | Smith | |
| 6,345,461 | B1 | 2/2002 | Constant et al. | |
| 6,360,468 | B1 | 3/2002 | Constant et al. | |
| 6,360,469 | B1 | 3/2002 | Mikuta et al. | |
| 6,370,806 | B1 | 4/2002 | Klebes et al. | |

(Continued)

OTHER PUBLICATIONS

Soldier Systems; 80 Percent Arms Introduces GST-9 Ghost: First Truly Modular 80% Pistol Frame System; Nov. 15, 2019 (http://soldiersystems.net/2019/11115/80-percent-arms-introduces-gst-9-ghost-first-truly-modular-80-pistol-frame-system/).

*Primary Examiner* — Stephen Johnson
(74) *Attorney, Agent, or Firm* — Stetina Brunda Garred & Brucker

(57) ABSTRACT

A modular firearm grip assembly has a frame defined by a front grip strap and a rear grip strap. The front grip strap defines a front lateral attachment point and rear lateral attachment point, and the rear grip strap has a first attachment coupling interface. A grip extension defined by a front extension strap and a rear extension strap is coupled to the frame at the respective one of the front lateral attachment point and the rear lateral attachment point thereof. The grip extension includes a second attachment coupling interface engaged to the first attachment coupling interface of the frame.

9 Claims, 3 Drawing Sheets

(56) References Cited

U.S. PATENT DOCUMENTS

| | | | |
|---|---|---|---|
| 6,397,508 | B1 | 6/2002 | Constant et al. |
| 6,405,473 | B1 | 6/2002 | Petig et al. |
| 6,421,944 | B1 | 7/2002 | Klebes et al. |
| 6,430,860 | B1 | 8/2002 | Constant et al. |
| 6,434,875 | B1 | 8/2002 | Constant et al. |
| 6,523,296 | B1 | 2/2003 | Constant et al. |
| D564,616 | S | 3/2008 | Novak |
| D584,374 | S | 1/2009 | McGarry |
| 7,694,449 | B1 | 4/2010 | Pontillo, II |
| 7,886,468 | B1 | 2/2011 | Pontollo, II |
| D644,291 | S | 8/2011 | Faifer |
| D647,589 | S | 10/2011 | Rogers et al. |
| D658,262 | S | 4/2012 | Rogers et al. |
| 8,151,504 | B1 | 4/2012 | Aiston |
| D745,625 | S | 12/2015 | Acarreta et al. |
| D785,127 | S | 4/2017 | Braswell |
| D788,251 | S | 5/2017 | Sylvester et al. |
| 9,651,325 | B1 | 5/2017 | Gant et al. |
| D792,546 | S | 7/2017 | Geissele |
| D795,988 | S | 8/2017 | Geissele |
| D813,339 | S | 3/2018 | Maroney |
| 10,054,391 | B1 | 8/2018 | Lyman |
| D830,490 | S | 10/2018 | Toole et al. |
| D840,491 | S | 2/2019 | Bowman et al. |
| D840,492 | S | 2/2019 | Bowman et al. |
| 2002/0088159 | A1 | 7/2002 | McMoore |
| 2006/0096147 | A1 | 5/2006 | Gussalli Beretta |
| 2006/0150467 | A1 | 7/2006 | Poulin et al. |
| 2006/0162225 | A1 | 7/2006 | Danielson |
| 2009/0183416 | A1 | 7/2009 | Danielson |
| 2009/0293335 | A1 | 12/2009 | Danielson |
| 2010/0154275 | A1 | 6/2010 | Faifer |
| 2010/0212203 | A1 | 8/2010 | McGarry |
| 2010/0236121 | A1 | 9/2010 | McGarry |
| 2011/0167698 | A1 | 7/2011 | Hoguc |
| 2011/0179688 | A1 | 7/2011 | Ash, Jr. et al. |
| 2011/0219656 | A1 | 9/2011 | McGarry |
| 2012/0167430 | A1 | 7/2012 | Freed |
| 2012/0222342 | A1 | 9/2012 | Chvala |
| 2013/0139426 | A1 | 6/2013 | Baxley |
| 2014/0007479 | A1 | 1/2014 | Glock |
| 2014/0250755 | A1 | 9/2014 | Hogue |
| 2015/0121738 | A1 | 5/2015 | Zajk et al. |
| 2016/0282082 | A1 | 9/2016 | Porat |
| 2016/0349002 | A1 | 12/2016 | Anderson |
| 2016/0349003 | A1 | 12/2016 | Tusting |
| 2017/0205188 | A1 | 7/2017 | Chavez |
| 2017/0254613 | A1 | 9/2017 | Kedairy |
| 2018/0010880 | A1 | 1/2018 | Porat |
| 2018/0031342 | A1 | 2/2018 | Faifer |
| 2018/0266778 | A1 | 9/2018 | Noonan et al. |
| 2018/0274876 | A1 | 9/2018 | Stewart et al. |
| 2018/0372443 | A1 | 12/2018 | Lyman |
| 2019/0017782 | A1 | 1/2019 | Toole et al. |
| 2019/0063864 | A1 | 2/2019 | Stewart et al. |
| 2019/0107348 | A1* | 4/2019 | Harrigan ..... F41A 5/02 |
| 2020/0278167 | A1* | 9/2020 | Hughes ..... F41C 23/10 |

* cited by examiner

MODULAR HANDGUN GRIP ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to firearms, and more particularly, to a modular handgun grip assembly.

2. Related Art

Firearms, and in particular, handguns, are widely relied upon by citizens, law enforcement, and the military alike. One of the chief uses of handguns is personal defense, as handguns, and firearms in general level the field and equalize inherent power balances between persons of differing strength and size. Aside from the specific instances in which a handgun is fired or displayed for fending off an attack, many participate in training to improve marksmanship and weapons handling skills to prepare for such defensive scenarios. There are also competitions that involve skills crossing over to those useful for employing a handgun in self-defense, such as proper aiming, trigger control, shot placement, reloading, and malfunction clearing. Time constraints, shooter movement, moving targets and/or scoring that factors both speed and accuracy may increase stress to such levels that are closer to those encountered during a self-defense situation. While self-defense and training therefor serve valuable practical objectives, recreational shooting or plinking may be enjoyed in its own right, and handguns are widely utilized for the same. Furthermore, handguns may also be utilized for hunting wild game at close to medium range distances.

The most common types of modern handguns are revolvers and self-loading pistols, though break-action pistols are also available. Revolvers have a rotating cylinder with multiple chambers each loaded with an ammunition cartridge. The chambers are sequentially rotated to align with a breach of the barrel and a firing mechanism that is typically a firing pin that is struck by a hammer, or a hammer with a firing pin affixed thereto. Pulling the trigger releases the hammer, striking the primer on the cartridge and igniting the gunpowder contained in the cartridge to propel the bullet through the barrel and out of the muzzle end.

Self-loading pistols, on the other hand, feed ammunition cartridges from a removable magazine. More particularly, there is a breech slide that reciprocates along a frame and locks against a barrel. The uppermost round of ammunition in the magazine is pushed toward the reciprocating path of the slide by the spring-loaded follower, and as the slide returns to battery, the cartridge is pushed into the chamber in the barrel. Actuating the trigger releases the hammer or the striker against the primer, likewise igniting the gunpowder in the cartridge to propel the bullet through the barrel.

The recoil of the firing cartridge is utilized to cycle the slide rearward, with the extractor pulling the spend casing from the chamber. Along its rearward path, the casing encounters an ejector, which redirects the movement of the case towards the ejection port and outwards from the firearm. The frame of the pistol has a grip defined by a front strap, a back strap, and a pair of opposed lateral panels or panel sections. Forward of the grip and extending from the frame is the trigger, and within the frame there are additional fire control components that actuate the spring-loaded mechanism that strikes the firing pin or that releases the striker. Surrounding the trigger and also defining a part of the frame is the trigger guard. The grip protrudes from the portion of the frame that interfaces with the reciprocating slide, and is hollow to receive the magazine. A magazine catch retains the magazine in place, though actuating a release that is located proximally to the grip may disengage the magazine catch. Additional control components such as slide release, thumb safety, grip safety, and/or decocker may also be nearby the grip.

Self-loading pistols are offered in a variety of sizes for different uses and user anatomies, and classified by manufactures according to one of several generally accepted categories including full size, compact size, subcompact size, and pocket size. Compact, subcompact, and pocket sizes are typically suitable for concealed carry, and thus have smaller grips and lower ammunition capacity. Many modern compact and some subcompact pistols utilize double stack magazines that have at least a ten round capacity, while smaller subcompact and pocket pistols utilize single stack magazines that limit capacity to under ten rounds. Concealability requirements are minimized for duty applications, so full-size pistols therefor tend to have larger frames and grips, and magazine capacities well into the double digits. Competition-oriented pistols are larger and heavier still for improved stability without any concerns pertaining to carry.

Repetitive and consistent training is ideal for improving marksmanship and overall weapons-handling proficiency. Thus, training on a single firearm or firearm platform having the same grip angle, trigger pull, and controls manipulation is preferable. Although most manufacturers offer a line of pistols from subcompact to full size, different ones are needed depending on the intended use and mode of carry. For instance, a shorter grip may be preferred notwithstanding reduced magazine capacity for concealed carry, while a longer grip may be acceptable in exchange for increased magazine capacity for competition and duty. With regard to concealability, grip size/length is among the chief concerns because while the slide is hidden within the inside waistband, the grip protrudes prominently from the profile of the body and result in the visibility of an outline of the weapon. Furthermore, the size and shape of the hand differs substantially from one person to another, and most grips are sized to fit most, not all. Those with smaller hands may be unable to wrap the palm and fingers around the entirety of a wide grip, while those with larger hands may be forced to handle the grip with fewer than all fingers. For certain competition-oriented pistols, flared magazine wells may be preferred for faster reloads, while any protrusion in a concealed carry pistol may be undesirable.

There is accordingly a need in the art for a firearm frame and modular grip system that can be interchanged with grip lengths and backstraps of differing lengths and thicknesses. There is also a need in the art for a modular grip system that can modified to accept and fully enclose within the magazine well magazines of varied capacities.

BRIEF SUMMARY

An embodiment of the present disclosure may be a modular firearm grip assembly. The assembly may include a hollow grip body that is receptive to an ammunition magazine. Furthermore, the grip body may be defined by a body front strap, a body back strap, and opposed left and right grip panel portions. The body front strap may define a front cross bore, and the body back strap may define a recessed portion with a body strap coupling interface that extends centrally along the hollow grip body. The body back strap may additionally define a rear cross bore. The assembly may further include a grip attachment that is defined by an attachment front strap and an attachment back strap. The attachment front strap may define a front cross bore. The attachment back strap may include an interior attachment coupling interface that extends centrally along the grip attachment and may be engageable to the body strap coupling interface of the grip body. The attachment back strap may define a rear cross bore. With the grip attachment coupled to the hollow grip body, the front cross bore of the body front strap and the front cross bore of the grip attachment may be axially aligned. Additionally, the rear cross bore of the body back strap and the rear cross bore of the attachment back strap may be axially aligned. The grip assembly may also include a front coupling fastener that is insertable through the front cross bore of the body front strap and the front cross bore of the attachment back strap. The grip assembly may further include a rear coupling fastener that is insertable through the rear cross bore of the body back strap and the rear cross bore of the attachment back strap.

According to another embodiment of the present disclosure, there is a firearm. The firearm may include a frame with a pistol grip receptive to an ammunition magazine. The frame may also be defined by a front grip strap and a rear grip strap. The front grip strap may define a front lateral attachment point and rear lateral attachment point. Additionally, the rear grip strap may include a first attachment coupling interface. The firearm may also include a grip extension that is defined by a front extension strap coupled to the frame at the front lateral attachment point thereof. The grip extension may further include a second attachment coupling interface that is engaged to the first attachment coupling interface of the frame. The grip extension may also be defined by a rear extension strap that is coupled to the frame at the rear lateral attachment point thereof.

According to yet another embodiment of the present disclosure, there is a firearm grip assembly that may include a pistol grip defined by a front grip strap and a rear grip strap. The front grip strap may define a front lateral attachment point and rear lateral attachment point. The firearm may also include a grip extension that is defined by a front extension strap coupled to the pistol grip at the front lateral attachment point thereof, and a rear extension trap that is coupled to the pistol grip at the rear lateral attachment point thereof. Either the front grip strap or the rear grip strap may define a first attachment coupling interface, and a corresponding one of either the front extension strap or the rear extension strap may include a second attachment coupling interface engaged to the first attachment coupling interface of the pistol grip.

The present disclosure will be best understood accompanying by reference to the following detailed description when read in conjunction with the drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the several presently contemplated embodiments of a modular handgun grip assembly and is not intended to represent the only form in which such embodiments may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
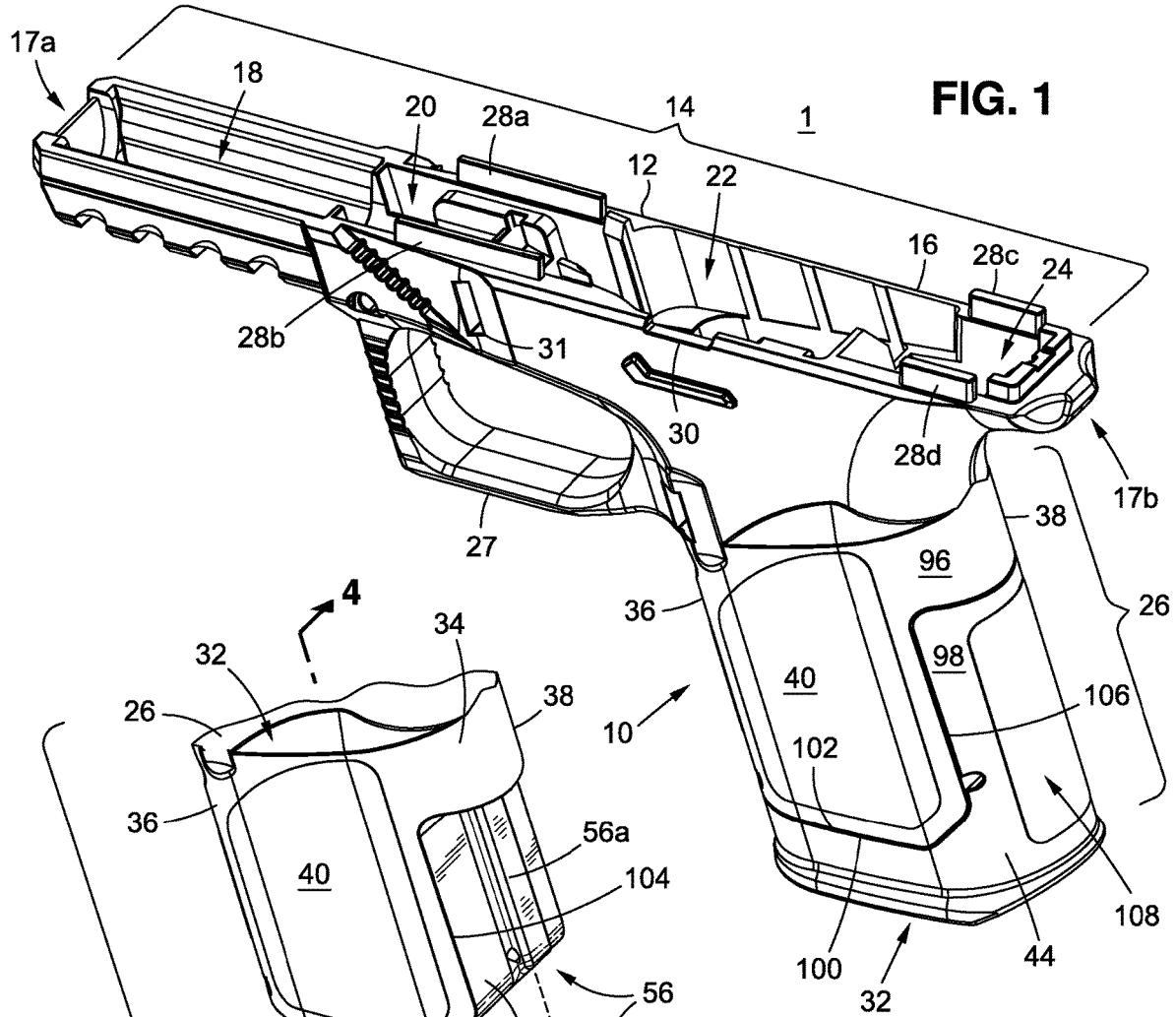
FIG. 1 is a perspective view of a firearm according to one embodiment of the present disclosure.

Referring now to FIG. 1, the present disclosure contemplates a modular handgun grip assembly 10, a part of which is a frame 12 of a self-loading semiautomatic pistol 1. The frame 12 is generally defined by an elongate body 14 with an open top lip 16, a front or muzzle end 17*a*, and opposed rear or butt end 17*b*. While being of unitary construction, the frame 12 may be segregated into a dust cover housing section 18, a locking block receptacle section 20, a magazine well opening section 22, and action receptacle section 24. Extending at an angular relationship to the elongate body 14 is a handle or grip 26, along with a trigger guard 27 connected to the grip 26 and the elongate body 14.

Although not shown in the drawings, a breech slide is engageable to the frame 12 in a reciprocating relationship thereto. The open top lip 16 of the frame 12 includes a series of slide rails 28*a*-28*d* with which the breech slide engages. In particular, a first pair of left and right slide rails 28*a* and 28*b* are positioned at the locking block receptacle section 20, while a second pair of left and right slide rails 28*c* and 28*d* are positioned at the action receptacle section 24.

In order to reduce the overall weight of the self-loading semiautomatic pistol 1, the frame 12 thereof may be constructed of a polymer material such as fiberglass-reinforced nylon that is currently sold by DuPont de Nemours, Inc. under the trade mark Zytel®, though any other suitable high-strength polymer material may be substituted without departing from the scope of the present disclosure. Certain pressure-containing components such as the barrel and the breech slide are constructed of steel, as are any components that interface therewith such as the barrel locking block and the slide rails 28. As will be appreciated by those having ordinary skill in the art, the barrel is rotatably coupled to the barrel locking block. Depending on the position of the breech slide to which the barrel is also engaged during certain points in the cycling of the firearm, the barrel may be locked or unlocked from the breech slide. In one embodiment, metallic inserts may be co-molded with the polymer extensions of the slide rails 28. Alternatively, however, it is possible to construct the entirety of the slide rails 28 with the same polymer material of the frame 12.

In the dust cover housing section 18, there may be a recoil spring assembly that is compressively retained between the slide and the barrel. Those having ordinary skill in the art will recognize that the recoil spring assembly assists in the return of the breech slide into battery upon extraction/ejection of the spent casing and completed its full rearward travel.

The action receptacle section 24 receives a trigger mechanism housing that incorporates the ejector and the connector that mechanically links the trigger to the striker, which is located in the breech slide along with the extractor. A trigger extends downwardly from the elongate body 14 into the open area defined by the trigger guard 27. The trigger is mechanically linked to the connector that is to the rear of the grip 26 with a trigger bar. In addition to the trigger, the firearm is understood to incorporate a slide release, with a slot 30 that receives the same when disengaged. Those having ordinary skill in the art will recognize that the slide release is pushed upwards by the magazine follower that is under spring pressure, holding the breech slide in the rearward position with a notch that is defined therein at such position. The breech slide is maintained in engagement with the frame 12 with a slide lock under spring pressure and located within the slide lock slot 31 defined by the frame 12. The breech slide may be separated from the frame by manually disengaging the slide lock.

As noted above, a self-loading semiautomatic pistol 1 as pictured in FIG. 1 accepts a magazine that is inserted from the bottom of the grip 26, and positions the ammunition cartridges within the reciprocating travel path of the breech slide. A follower in the magazine is upwardly biased by an internal magazine spring, forcing the cartridges upwards. The feed lips of the magazine holds the uppermost cartridge in place, and the lateral movement of the breech slide disengages the cartridge from the feed lips. The cartridge may be lifted upwards and enter the chamber of the barrel. The magazine thus protrudes partially from the magazine well opening section 22 of the elongate body 14.

The foregoing description of the functional features of the self-loading semiautomatic pistol 1 is understood to correspond to those of the Glock® pistols, further described in U.S. Pat. No. 4,539,889. Accordingly, only those features deemed pertinent to the frame 12 as illustrated as being part of the modular handgun grip assembly 10 have been described. It will be appreciated that any other configuration of a self-loading pistol may be substituted without departing from the scope of the present disclosure.

Again, the modular handgun grip assembly 10 includes the frame 12 of the self-loading semiautomatic pistol 1, which includes the aforementioned grip 26. With additional reference to FIGS. 2 and 3, the grip 26 is understood to be hollow and receptive to an ammunition magazine, and thus defines an open bottom end 32. This hollow portion may be referred to as a magazine well 33. The interior shape and contour of the magazine well 33 is understood to conform to that of the ammunition magazine received therein. As explained above, one exemplary embodiment of the self-loading semiautomatic pistol 1 may conform to the design specifications of a Glock® pistol. Thus, the magazines utilized by the self-loading semiautomatic pistol 1 may likewise be a standard Glock®-compatible magazine. It will be appreciated that the magazine, and hence the magazine well 33, may also be specific to the caliber of the ammunition chambered for the self-loading semiautomatic pistol 1.

Figure 3:
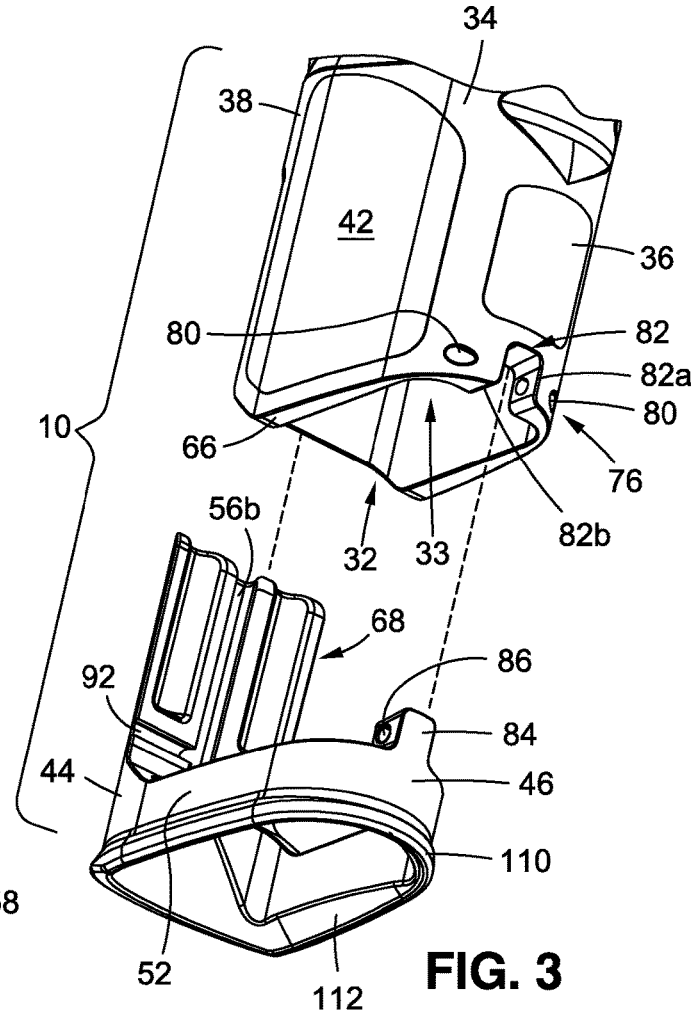
FIG. 3 is an exploded detailed perspective view of the pistol grip and the grip extension from a rearward viewpoint.

The grip 26 may be characterized by a grip body 34, and it may also be defined by a front grip strap 36 and an opposed rear grip strap 38. In some embodiments, the front grip strap 36 may also be referred to as a body front strap, while the rear grip strap 38 may be referred to as a body back strap. The grip 26 also has left side segment or panel 40, and as best illustrated in FIG. 3, an opposed right side segment or panel 42. Although the exemplary embodiments show the grip body 34 being part of the frame 12, this is by way of example only and not of limitation. The features of the present disclosure may be implemented in any other firearm grip assembly utilized in other types of firearms, including different pistols that have a grip that do not accept a magazine, rifles, shotguns, and so forth.

Figure 4:
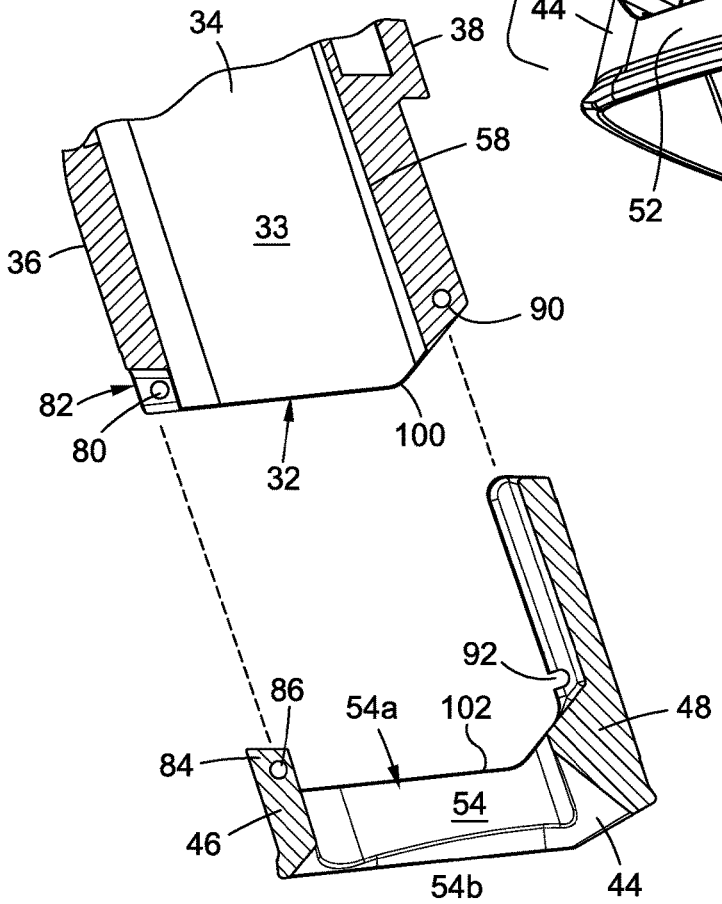
FIG. 4 is an exploded cross-section view of the pistol grip and the grip extension taken along axis 4-4 of FIG. 2.

According to the various embodiments of the present disclosure, the modular handgun grip assembly 10 also includes a grip attachment or extension 44 that is removably coupled to the grip body 34. The cross-sectional view of FIG. 4 best illustrate the grip extension 44 as being defined by a front extension strap 46 and an opposed rear extension strap 48. In some embodiments, the front extension strap 46 may also be referred to as an attachment front strap, and the rear extension strap 48 may also be referred to as an attachment back strap.

Figure 2:
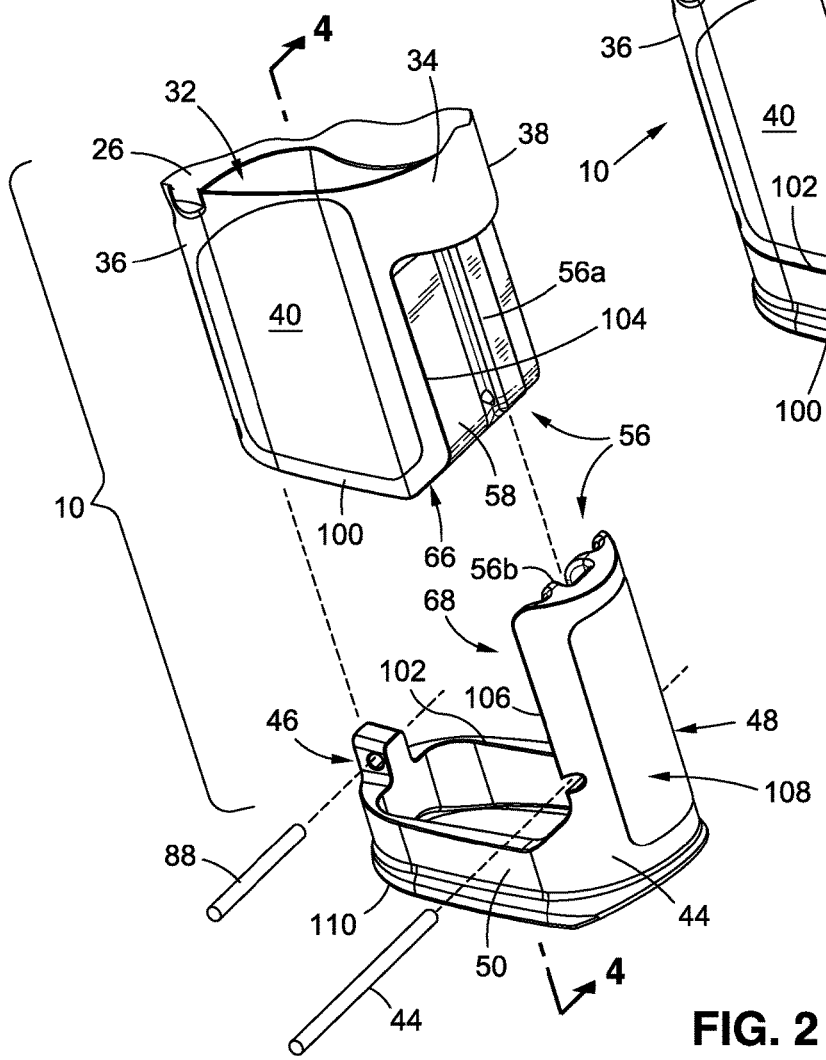
FIG. 2 is an exploded detailed perspective view of one embodiment of a pistol grip and a grip extension from a forward viewpoint.
Figure 6:
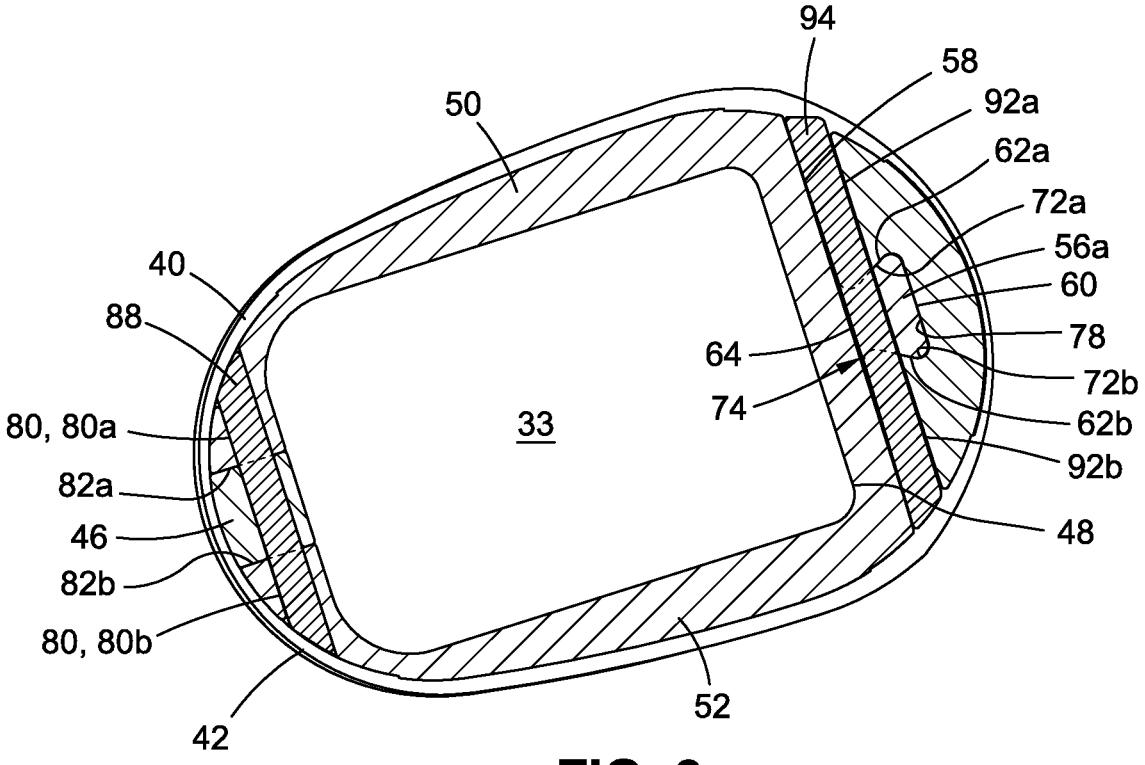
FIG. 6 is a cross sectional view of the pistol grip and the grip extension taken along axis 6-6 of FIG. 5.

The front and rear perspective views of FIG. 2 and FIG. 3, along with the cross-sectional view of FIG. 6 show the body of the grip extension 44 as being further defined by a left side segment 50 or left rim half and an opposed right side segment 52 or right rim half. The left side segment 50 and the right side segment 52 are understood to be contiguous with both the front extension strap 46 and the rear extension strap 48, and in a preferred though optional embodiment best illustrated in the cross-sectional view of FIG. 4, has a unitary structure defined by a hollow interior 54 with an upper open end 54*a* and a lower open end 54*b*.

The grip extension 44 may be secured to the grip 26 with an attachment coupling interface 56, which according to one embodiment, is a dovetail coupling. A first attachment coupling interface 56*a*, e.g., a dovetail rail, is defined in a recessed portion 58 of the rear grip strap 38. This dovetail rail may also be referred to as a body strap coupling interface. FIG. 6 best illustrates the dovetail rail with a front face 60, and left and right tapered sides 62*a*, 62*b* that terminate at a base 64 that is contiguous with the outward surface of the recessed portion 58. The dovetail rail is understood to be centrally disposed on the rear grip strap 38, and extends the entire length from the beginning of the recessed portion 58 to a bottom grip body end 66. A second attachment coupling interface 56*b*, e.g., a dovetail slot, is defined in an interior side 68 of the grip extension 44. This dovetail slot may also be referred to as an interior attachment coupling interface. Again, as shown in FIG. 6, the dovetail slot has a rear face 70 and left and right sidewalls 72*a*, 72*b* that taper to an opening 74. The dovetail rail is inserted into the dovetail slot, that is, the slot is slidably receptive of the rail, thus securing the grip extension 44 to the grip 26. In alternative embodiments, the first attachment coupling interface 56*a* may be the dovetail slot, and the second attachment coupling interface 56*b* may be the dovetail rail. The specifics of the dovetail coupling is presented by way of example only, and any other suitable coupling mechanism may be substituted without departing from the scope of the present disclosure.

Figure 5:
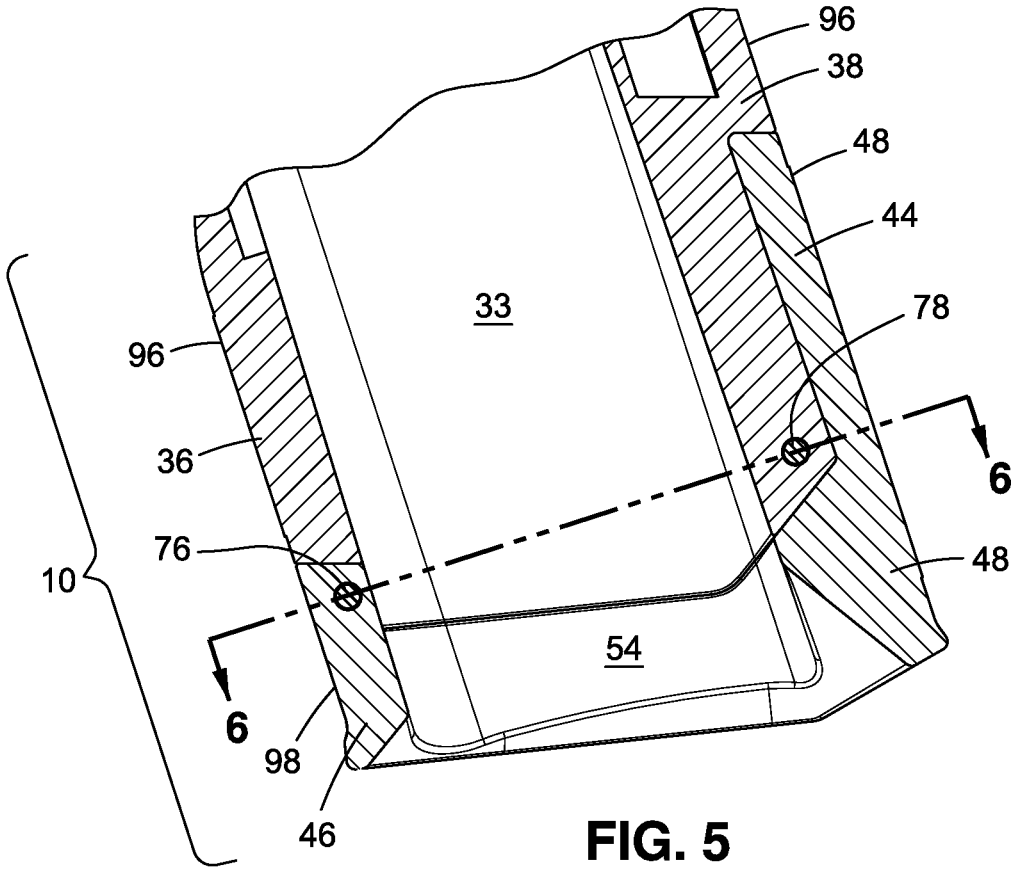
FIG. 5 is a cross-sectional view of the firearm with the pistol grip and the grip extension coupled to each other.

As shown in FIG. 5, the grip extension 44 may also be coupled to the grip 26 at least at a front lateral attachment point 76 and a rear lateral attachment point 78. The front lateral attachment point 76 and the rear lateral attachment point 78 are understood to correspond to features in both the grip body 34 and the grip extension 44.

With specific reference to FIGS. 2, 3, 4, and 6, in the grip body 34, the front lateral attachment point 76 corresponds to a front cross bore 80 defined in the front grip strap 36. There is a notch 82 in the front grip strap 36, and so the front cross bore 80 has a left segment 80*a* defined between the left side panel 40 and the left side interior 82*a* of the notch 82. Additionally, the front cross bore 80 has a right segment 80*b* defined between the right side panel 42 and the right side interior 82*b* of the notch 82.

The notch 82 is configured to receptively engage a projection 84 on the grip extension 44. The projection 84 defines a front cross bore 86 extending laterally across the projection 84. When the projection 84 is inserted within the notch 82, the front cross bore 86 of the projection 84 is understood to be axially aligned with the front cross bore 80 of the grip body 34, thus defining the front lateral attachment point 76. According to one embodiment, a front fastener 88 is inserted through the front cross bores 80, 86, to at least partially secure the grip extension 44 to the grip body 34. The front fastener 88 may be a cylindrical pin, a roll pin, or any other component or structure that couples the grip extension 44 to the grip body 34.

In the grip body 34, the rear lateral attachment point 78 corresponds to a rear cross bore 90 extending across the rear grip strap 38, and specifically the attachment coupling interface 56. Because of the contemplated location of the rear cross bore 90 is behind the recessed portion 58, it extends only through the dovetail rail.

In the grip extension 44, the rear extension strap 48 thereof defines a rear cross bore 92. Specifically, the rear cross bore 92 has a left segment 92*a* defined between the left side segment 50 and the left sidewall 72*a* of the dovetail slot or second attachment coupling interface 56*b*, and a right segment 92*b* defined between the right side segment 52 and the right sidewall 72*b* of the dovetail slot or second attachment coupling interface 56*b*. In a preferred, though optional embodiment, the rear cross bore 92 may be configured as more of an open partially cylindrical slot, depending on the relative position thereof. The dovetail slot is understood to interrupt the continuity of the rear cross bore 92, hence the delineation of the left and right segments 92*a*, 92*b*. This is by way of example only and not of limitation, however.

With the grip extension 44 fully inserted on to the grip body 34, the rear cross bore 92 of the grip extension 44 is understood to be axially aligned with the rear cross bore 90 of the grip body 34, thus defining the rear lateral attachment point 78. A rear fastener 94 is inserted through the rear cross bores 90, 92, to at least partially secure the grip extension 44 to the grip body 34. The rear fastener 94, like the front fastener 88 described above, may be a cylindrical pin, a roll pin, or any other component or structure that couples the grip extension 44 to the grip body 34. Along these lines, while specific cross bores were described as defining the front lateral attachment point 76 and the rear lateral attachment point 78, with the aforementioned fasteners or cylindrical pins coupling the grip extension 44 to the grip body 34, this is by way of example only and not of limitation. Any other suitable structure may comprise the front lateral attachment point 76 and the rear lateral attachment point 78, and any other coupling modality such as click-together attachment systems, buckles, and the like may be utilized.

Furthermore, while the illustrated embodiments show the attachment coupling interface 56 on the rear strap of the grip 26 and the grip extension 44, with the notch 82 and the projection 84 within which it is received being defined on the front strap of the grip 26 and the grip extension 44, respectively, this is also by way of example only and not of limitation. Alternatives in which the attachment coupling interface 56 is on the front strap and the notch 82/projection 84 are on the rear strap are also contemplated.

When the grip extension 44 is coupled to the grip body 34, it is contemplated to effectively become an extension of the grip 26. That is, a continuous outer contour is defined by the outer surface 96 of the grip body 34 and the outer surface 98 of the grip extension 44. Each of the interfacing or abutting structural elements of the grip body 34 and the grip extension 44 are complementary, in that there is a minimal gap between the two. Specifically, the grip body 34 defines a bottom lip 100 having a specific shape, and the grip extension 44 has a complementary upper lip 102 matching the profile of the bottom lip 100. As shown in FIG. 1, the bottom lip 100 of the grip body 34 abuts against the upper lip 102 of the grip extension 44. Likewise, a contour edge 104 of the recessed portion 58 is complementary with a contour edge 106 of an elongate backstrap section 108 of the grip extension 44.

Beyond this border interface, however, the contour or profile of the grip extension 44 may be vary from that of the grip body 34. In order to accommodate smaller hands, the elongate backstrap section 108 may be reduced in circumference. However, the ergonomics for larger hands may be better with the elongate backstrap section 108 having an increased circumference. The shape of the elongate backstrap section 108 may be varied according to user preference as well.

Referring now to FIGS. 2 and 3, the grip extension 44 likewise defines a bottom lip 110, and some embodiments contemplate this being flared outwardly. An inner portion 112 of the bottom lip 110 may be beveled to maximize the size of the opening to the hollow interior 54 of the grip extension 44 as well as the magazine well 33. Such elimination of sharp corners around the insertion point of the magazine is contemplated to gradually guide the same into the magazine well 33. That is, sharp edges and obstructions that can altogether break a reload attempt are reduced. This is understood to facilitate faster reloads, where the angle of insertion may not be in perfect alignment with the axis of the magazine well 33. In other embodiments, the flare on the bottom lip 110 may be undesirable as increasing the outline of the grip 26. In addition to the foregoing, the grip extension 44 may be customized with other structural features that enhance the bottom end portion such as palm shelves and the like.

The particulars shown herein are by way of example and for purposes of illustrative discussion of the embodiments of the modular handgun grip assembly and are presented in the cause of providing what is believed to be the most useful and readily understood description of the principles and conceptual aspects. In this regard, no attempt is made to show details with more particularity than is necessary, the description taken with the drawings making apparent to those skilled in the art how the several forms of the present disclosure may be embodied in practice.

What is claimed is:

1. A modular firearm grip assembly, comprising:

a hollow grip body receptive to an ammunition magazine and defined by a body front strap, a body back strap, and opposed left and right grip panel portions, the body front strap defining a front cross bore, and the body back strap defining a recessed portion with a body strap coupling interface extending centrally along the hollow grip body and a rear cross bore;

a grip attachment defined by an attachment front strap and an attachment back strap, the attachment front strap defining a front cross bore, and the attachment back strap including an interior attachment coupling interface extending centrally along the grip attachment and engageable to the body strap coupling interface of the grip body, the attachment back strap defining a rear cross bore, with the grip attachment coupled to the hollow grip body, the front cross bore of the body front strap and the front cross bore of the grip attachment being axially aligned, and the rear cross bore of the body back strap and the rear cross bore of the attachment back strap being axially aligned;

a front coupling fastener insertable through the front cross bore of the body front strap and the front cross bore of the attachment back strap; and a rear coupling fastener insertable through the rear cross bore of the body back strap and the rear cross bore of the attachment back strap.

2. The modular firearm grip assembly of claim 1, wherein the body front strap defines a notch receptive to a projection in the attachment front strap, and the projection defines the front cross bore.

3. The modular firearm grip assembly of claim 1, wherein the grip attachment is further defined by a right rim half and an opposed left rim half each contiguous with the respective attachment front strap and attachment back strap and defining an annular attachment structure.

4. The modular firearm grip assembly of claim 1, wherein an outer surface of the body back strap and an outer surface of the attachment back strap together define a continuous back strap contour.

5. The module firearm grip assembly of claim 1, wherein an outer surface of the body front strap and an outer surface of the attachment front strap together define a continuous front strap contour.

6. The modular firearm grip assembly of claim 1, wherein the body strap coupling interface is a dovetail rail, and the interior attachment coupling interface is a dovetail slot slidably receptive of the dovetail rail.

7. The modular firearm grip assembly of claim 1, wherein the grip attachment is defined by a top end facing the grip body, and an opposed bottom end.

8. The modular firearm grip assembly of claim 7, wherein the bottom end is flared.

9. The modular firearm grip assembly of claim 1, wherein the front coupling fastener and the rear coupling fastener are cylindrical pins.

* * * * *